US006550211B2

(12) United States Patent
Kergen

(10) Patent No.: US 6,550,211 B2
(45) Date of Patent: Apr. 22, 2003

(54) GIRDER STRUCTURE AND METHOD FOR PRODUCING SUCH STRUCTURES

(75) Inventor: Richard Kergen, Fexhe-Le-Haut-Clocher (BE)

(73) Assignee: Recherche & Developpement du Groupe Cockerill Sambre, Liege (BE)

( * ) Notice: Subject to any disclaimer, the term of this patent is extended or adjusted under 35 U.S.C. 154(b) by 0 days.

(21) Appl. No.: 10/035,220

(22) Filed: Jan. 4, 2002

(65) Prior Publication Data

US 2002/0053178 A1 May 9, 2002

Related U.S. Application Data

(63) Continuation of application No. PCT/BE00/00079, filed on Jul. 5, 2000.

(30) Foreign Application Priority Data

Jul. 5, 1999 (EP) ..... 99202192

(51) Int. Cl.[7] ..... E04B 2/00
(52) U.S. Cl. ..... 52/729.2; 52/729.3; 52/729.1
(58) Field of Search ..... 52/726.2, 729.2, 52/729.3, 731.1, 731.2, 729.1

(56) References Cited

U.S. PATENT DOCUMENTS 3,960,637 A 6/1976 Ostrow
3,999,354 A 12/1976 Anter et al.
4,734,146 A * 3/1988 Halcomb et al. ..... 156/148
5,483,782 A 1/1996 Hall
5,600,932 A * 2/1997 Paik et al. ..... 52/745.19
6,374,570 B1 * 4/2002 McKague, Jr. ..... 52/762

FOREIGN PATENT DOCUMENTS

| | | |
|---|---|---|
| DE | 2221330 | 11/1973 |
| DE | 3425495 A1 | 1/1986 |
| FR | 1234371 | 7/1959 |
| FR | 1312864 | 1/1962 |
| GB | 2187409 A | 9/1987 |

* cited by examiner

*Primary Examiner*—Carl D. Friedman
*Assistant Examiner*—Jennifer I. Thissell
(74) *Attorney, Agent, or Firm*—Jacobson Holman PLLC

(57) ABSTRACT

The invention concerns a beam structure comprising at least a wing (1, 1') made of at least a first metal and at least a core (2, 2') made of at least a second metal, said core being assembled substantially perpendicular to said wing and said core being a sheet material or sheet metal. The invention is characterised in that the first metal has a high or very high yield strength, and associated with a yield strength/tensile strength ratio close to 1, the second metal has a yield strength substantially lower than that of the first metal; the second metal has a yield strength/tensile strength ratio substantially less than 0.9 and less than the value of said ratio exhibited by the first metal.

25 Claims, 8 Drawing Sheets

GIRDER STRUCTURE AND METHOD FOR PRODUCING SUCH STRUCTURES

This is a continuation of PCT/BE00/00079 filed Jul. 5, 2000 and published in French.

SUBJECT OF THE INVENTION

The present invention relates to a built-up girder structure.

The present invention also relates to a method for producing such a girder structure.

TECHNOLOGICAL BACKGROUND AND PRIOR ART

Many varieties of cross sections of girders intended for various uses are obviously known. The most effective cross sections are those with a maximum metal content in the regions that are most remote from the neutral fibre.

More particularly, the standard I-girder, which comprises two flanges linked by a web, is a good solution, since the material located at the level of the flanges will determine the moment of inertia. In an elastic regime, the stresses and deformations linearly vary in the cross section: they are equal to zero at the neutral fibre and increase until they are maximal at the point most remote from the neutral fibre. The web, which securely fastens the two flanges together, is thus the site of bending stresses associated with the local moment, shear stresses associated with the local transverse force, and compressive stresses determined by the local loading.

It has recently been sought to produce lighter girder structures by reducing the amount of working material. In particular, it has been suggested to use shades of carbon steel with high mechanical strength characteristics, often associated with formability by limited deformation. The cost prices of the steels thus produced by known bulk metallurgical methods are similar to the prices of standard carbon steels and allow the production of lighter structures, being thus economically more advantageous.

To clarify matters, we will differentiate these steels according to their elastic limit (EL) in the remainder of the description:

mild steels: EL<250 MPa;

steels with a high elastic limit (HEL):
250 MPa<EL<600 MPa;

steels with a very high elastic limit (VHEL):
600 MPa<EL<1000 MPa;

steels with an ultra-high elastic limit (UHEL):
1000 MPa<EL<1500 MPa.

The steels with high mechanical characteristics mentioned in the present patent application mainly belong to the VHEL and especially the UHEL category.

Nevertheless, on account of their low formability and their sometimes poor weldability, these steels pose certain specific problems during assembly for example. In particular, the standard methods for producing or preparing girder structures are generally only suitable for producing a girder of permanent cross section, which obviously does not allow to optimise the weight of said girder structure.

The concept of a built-up girder is known. Thus, document DE-A-22 21 330 proposes a built-up bending girder, the flanges and web of which respectively consist of very high strength steel and of ordinary steel. The apparent elastic limit is exceeded in the region of the web close to the flange, but it is precisely the junction with the very high strength steel, maintaining an elastic behaviour, which prevents the web from flowing. A girder entirely consisting of very high strength steel and having the same behaviour as a girder of the same dimensions is thus obtained.

Similarly, document FR-A-1 312 864 describes an I-girder consisting of three welded parts and especially having a first flange made of low-carbon steel and a second flange made of high-carbon steel. The latter flange is intended to be used as a rail.

Document GB-A-2 187 409 proposes to reinforce the flanges of a steel girder by bonding additional strips made of steel with a different shade, of another metal or alternatively even of plastic.

Document U.S. Pat. No. 3,999,354 describes an aluminium girder with a rectangular hollow cross section, consisting of two extruded and profiled flanges assembled with two webs in the form of a panel. Assembly is obtained at each junction by local pinching: an arm belonging to the flange is folded by means of a tool into a groove of the same flange, the corresponding web panel being wedged between these two elements. This type of mechanical assembly is relatively incompatible with VHEL and UHEL steels, which have poor formability qualities.

Other techniques for assembling girders are known and described in documents U.S. Pat. No. 3,960,637 and U.S. Pat. No. 5,483,782 for example.

Patent application DE-A-34 25 495 describes an I-girder with a web reinforced by regular mouldings. This reinforcement is necessary when girders with webs of a certain height are used.

Document FR-A-1 234 371 proposes methods and devices for implementing welded alveolar girders.

AIMS OF THE INVENTION

The present invention aims to propose a girder structure allowing to reduce the weight thereof, while at the same time to use steel plates with high mechanical characteristics.

The present invention also aims to allow the efficient production of girder structures with variable cross section.

The present invention also relates to the method for producing a girder structure such as described above in a particularly efficient manner.

MAIN CHARACTERISTIC ELEMENTS OF THE INVENTION

The present invention relates to a girder structure comprising at least one flange (1, 1') made of at least one first metal with high mechanical characteristics, i.e. a high resistance, having an elastic limit/breaking load ratio close to 1, and at least one web (2, 2') made of at least one second metal having an elastic limit substantially inferior to that of the first metal, said web being essentially assembled perpendicular to said flange, said flange and said web being made of sheet or plate metal, characterized in that:

the second metal has an elastic limit/breaking load ratio substantially inferior to the value of said ratio of the first metal and of less than 0.9.

said web having geometrical characteristics that increase its buckling strength in comparison with a flat and full web of the same thickness and the same height, and decrease its thickness and consequently lower the total weight of the structure.

Preferably, the first metal is a steel with an elastic limit higher than 400 MPa or an aluminium alloy with an elastic limit higher than 200 MPa.

The webs may have corrugation, and in particular a succession of lances or apertures in the longitudinal direction of the girder structure.

Preferably, the girder structure comprises at least two flanges, at least one of which is made of the first metal, which are essentially parallel to each other and essentially assembled perpendicular to at least one element made of the second metal in order to produce a web.

According to the invention, the two flanges are made of the same metal, optionally of different thicknesses, or of different metals, a first flange being made of a metal with an elastic limit/breaking load ratio different from that of the metal of the other flange.

According to one particularly advantageous embodiment of the invention, the girder structure comprises at least two flanges essentially parallel to each other and connected together by at least two webs that are also essentially parallel to each other, in which the flanges and the webs are made of metallic materials that differ in their nature, their mechanical properties or their thickness.

In a particularly advantageous manner, the girder structure has a non-permanent cross section, which varies according to the height and/or width of said structure.

The invention also relates to a method for assembling a girder structure, comprising at least a flange and at least a web, such as those mentioned above, characterized in that said flange and said web are assembled in order to form a junction section by means of a fusion assembly method, preferably by spot welding, laser welding, seam welding, diffusion welding or brazing.

Alternatively, the assembly of said flange and said web in order to form a junction section is performed by a mechanical assembly method, preferably by riveting, simple crimping or clinching.

In a particularly advantageous manner, the assembly of said flange and said web in order to form a junction section is performed by an assembly method by hem crimping.

In this specific case, the ratio of the hem radius to the sum of the thicknesses of the various constituent elements along the junction section is preferably between 2 and 10. Similarly, the ratio of the difference between the radius of the hem and the thickness of the outermost constituent element to the thickness of the innermost constituent element is preferably higher than 2, and the thickness ratio of the two elements is preferably lower than 4.

The mechanical assembly operations (riveting, crimping, clinching or hem crimping) are preferably performed by means of a press.

Advantageously, the assembly by hem crimping is performed in the same press cycle.

In a particularly advantageous manner, the blocking of the hem made by the assembly method according to the invention with respect to the relative sliding of a web relative to a flange along the junction section may be achieved by bonding, indentation or imbrication.

SHORT DESCRIPTION OF THE FIGURES

FIGS. 8 show the blocking principle of the relative sliding of the web with respect to the flange in the hem assembly, by imbrication by means of alternate cut-out spaces.

DETAILED DESCRIPTION OF VARIOUS EMBODIMENTS OF THE PRESENT INVENTION

The proposed solution is based on the use of at least two metallic materials, in sheet or plate form, which differ in their nature, their mechanical properties or their thickness, in order to produce a more elaborate structure. More specifically, the present invention proposes to use steels with high mechanical characteristics in combination with more ductile steels in order to produce a girder structure of optimised weight that can optionally have a variable cross section according to certain embodiments. It is therefore a built-up structure made of at least two metallic materials that differ in nature, mechanical properties or thickness.

In a girder, the maximum stress level is reached at the level of the flanges. Thus, the material chosen to produce these flanges must have an elastic limit as high as possible. The cross section of the flange essentially determines the moment of inertia: thus, it must be possible to adjust the width and thickness in order to optimise the strength and bulk. The flanges may optionally be made of two metallic materials that differ at least in nature, mechanical properties or thickness for example, in order to optimise the weight of the girder relative to the loads or bulk stresses.

The web that connects the flanges is subjected to bending, but above all is the site of shear stresses and may locally be compression-stressed. In order to optimise the weight, it must be possible to use a minimum thickness of metal. This may be achieved by giving the webs a geometry that improves their buckling strength. This means that the metal used for the webs must be more ductile than the metal used for the flanges, i.e. it must have a lower elastic limit/breaking load ratio, and certainly a ratio of less than 0.9.

Figure 1:
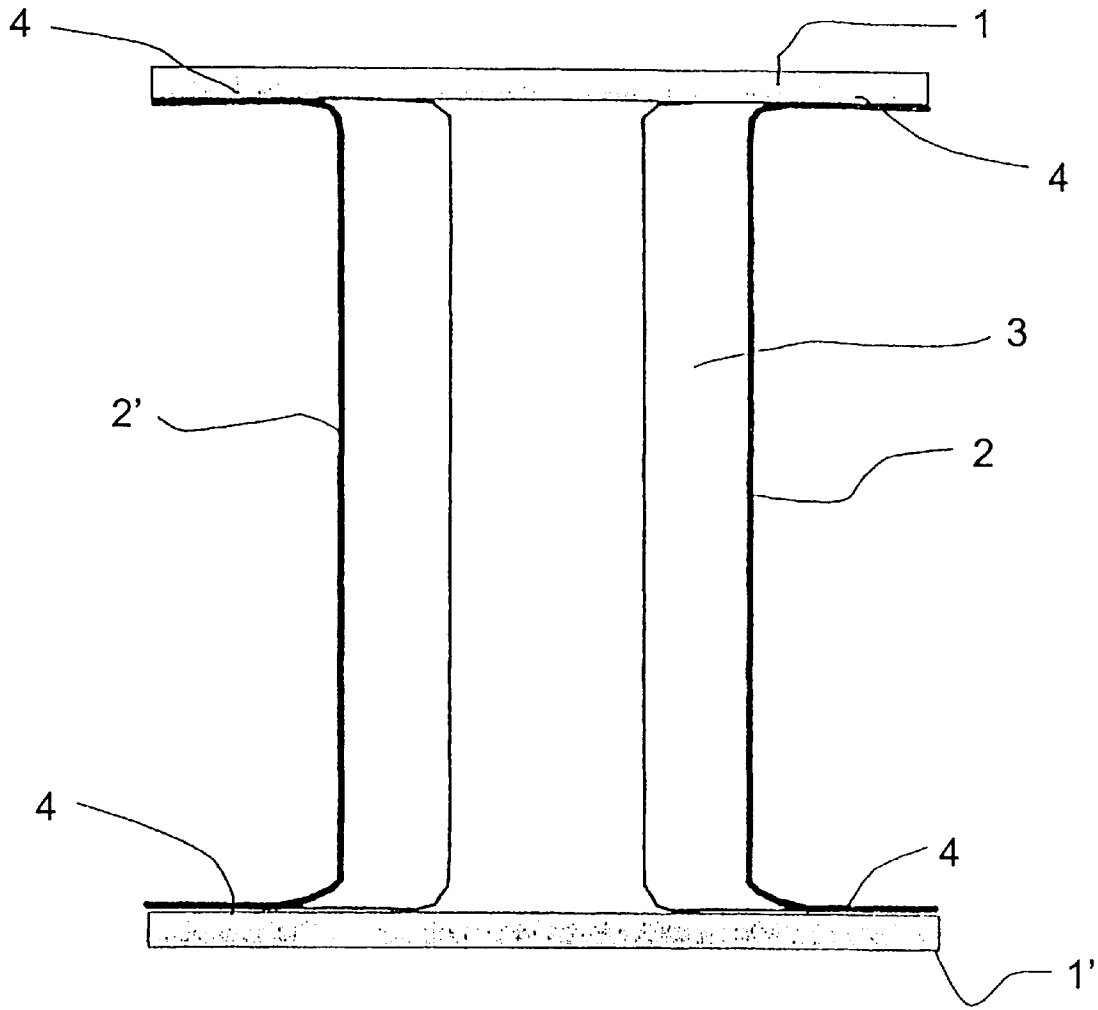
FIG. 1 is a cross-section view of a typical cross section of a girder structure according to the present invention.

A typical cross section corresponding to the invention is shown in FIG. 1.

The flanges 1 and 1' are made of a sheet or plate metal with a very high elastic limit (HEL, VHEL or UHEL), for example low carbon steel. The elastic limit is chosen as high as possible. For steel, it will be ranging from 400 to 1500 MPa, and for aluminium from 200 to 800 MPa: in this case, the metal may have a very limited formability.

Within a given alloy family, for example the steels or even the aluminium alloys, the higher the elastic limit, the lower the ductility. The ductility is clearly reflected by the elastic limit/breaking load ratio. For alloys with good formability, this ratio is thus markedly less than 1, of the order of 0.5, and for alloys with high mechanical properties, this ratio tends towards 1, being then associated with a very limited formability. The elastic limit level associated with this poor formability depends on the alloy family taken into consideration. For steels, this limit may thus range from 600 to 800 MPa depending on the shade considered.

Figure 2:
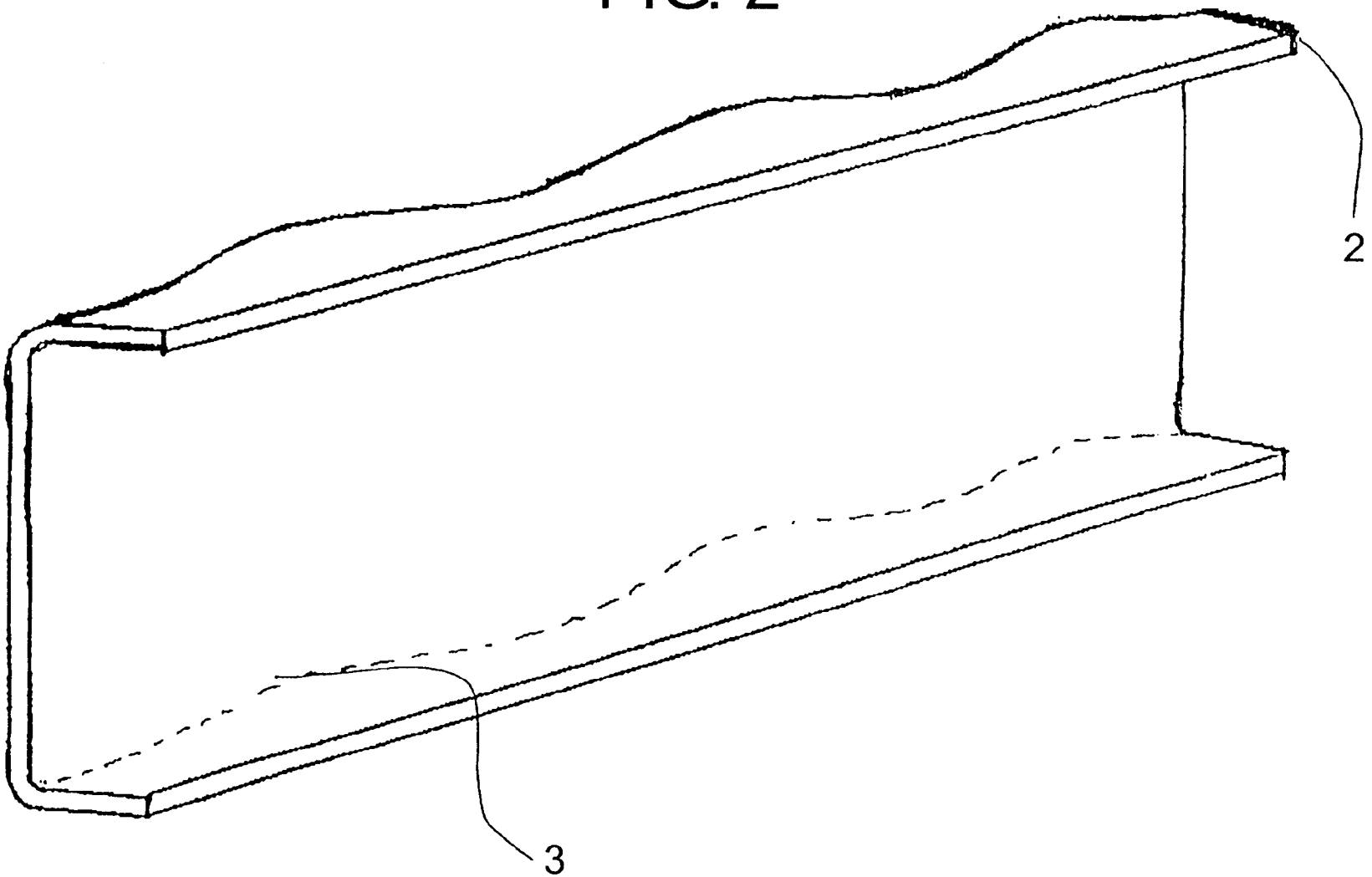
FIG. 2 shows an embodiment of a particular web used for a girder structure according to the present invention, and in particular such as shown in FIG. 1.

The webs 2 and 2' are made of a sheet or plate metal with a better ductility than the metal of the flanges, thus with a substantially lower level of the elastic limit/breaking load ratio, and in any case of less than 0.9. Ideally, the webs 2 and 2' are not flat but instead have for example a corrugation 3. A typical embodiment of the webs is shown in FIG. 2. The purpose of this corrugation is to reinforce the buckling strength of the webs: their thickness may thus be substantially reduced.

To produce this form, it is necessary to use a metal with a certain level of ductility (elastic limit/breaking load ratio).

Figure 3:
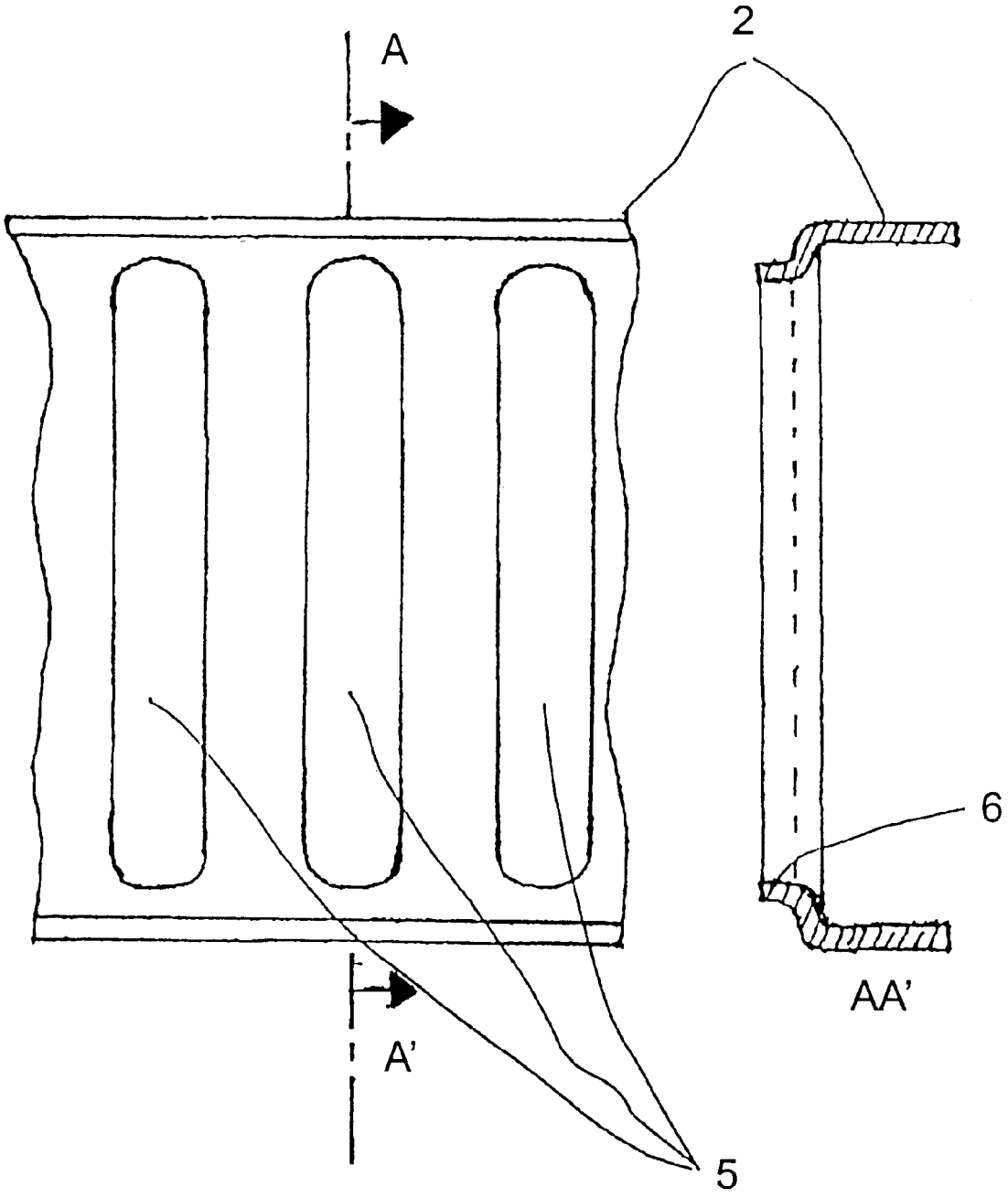
FIG. 3 shows another embodiment of a web which may be used for a girder structure, and in particular such as shown in FIG. 1.

The form presented herein is merely given by way of example: the principle is to take advantage of the deformability of the metal of the webs to give them a geometry that improves their buckling strength by compression: another embodiment of the webs is shown in FIG. 3. In this case, the reinforcement is obtained by means of lances 5 with a dropped edge 6 in the vertical wall of the web.

The flanges and the webs are securely fastened together at the level of the junction regions 4 by welding or mechanical assembly. Among the welding methods, spot welding, seam welding, laser welding, diffusion welding and brazing for example may be envisaged. In order to improve the production efficiency and to encounter the weldability problems posed by certain steels with a high elastic limit, mechanical assembly methods such as assembly by riveting, assembly without rivets by local deformation, known as clinching, and crimping should preferably be envisaged.

Figure 4:
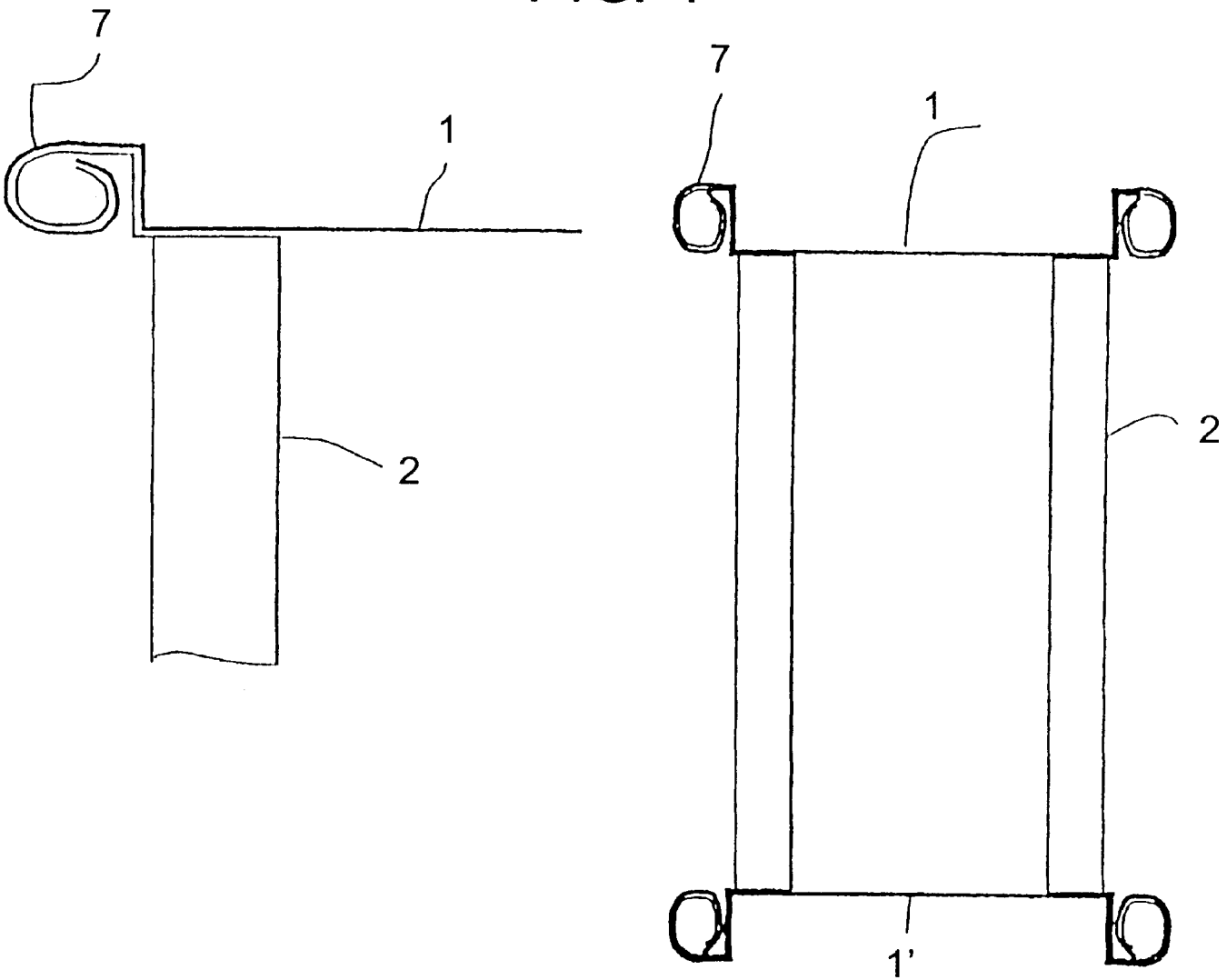
FIG. 4 shows the hem assembly of different parts in order to produce a girder structure such as shown in FIG. 1.

One particularly advantageous variant of the assembly method is hem assembling. This type of assembly applied to tins for example, may be performed with a press or with rotating tools of the seam type. A typical example of this type of assembly applied to the present invention is shown in FIG. 4. A hem 7 is produced at each junction region between flange 1 and web 2. The advantage of this type of assembly is twofold: on account of its geometry, it contributes to the reinforcement of the structure and it can be performed by means of highly efficient methods, for instance by means of a drawing press or a profiling machine.

However, in the case of hem assembling, there is an appreciable risk that the assembled elements will slide in the axis of the girder or at least in the longitudinal direction if the girder is not rectilinear.

This drawback may be readily solved for example by placing an adhesive between the two sheets of metal at the hem, by producing welds by local fusion or preferably, by locally crushing the hem with a press tool comprising, for example, a V-shaped indenting punch with a rounded end and a flat anvil. This operation may be performed with a press in a highly efficient manner: tools may indeed be designed to simultaneously perform the indentation of at least two hems, the indentation pitch being of the order of 5 to 10 times the outside diameter of the hem.

Figure 8A:
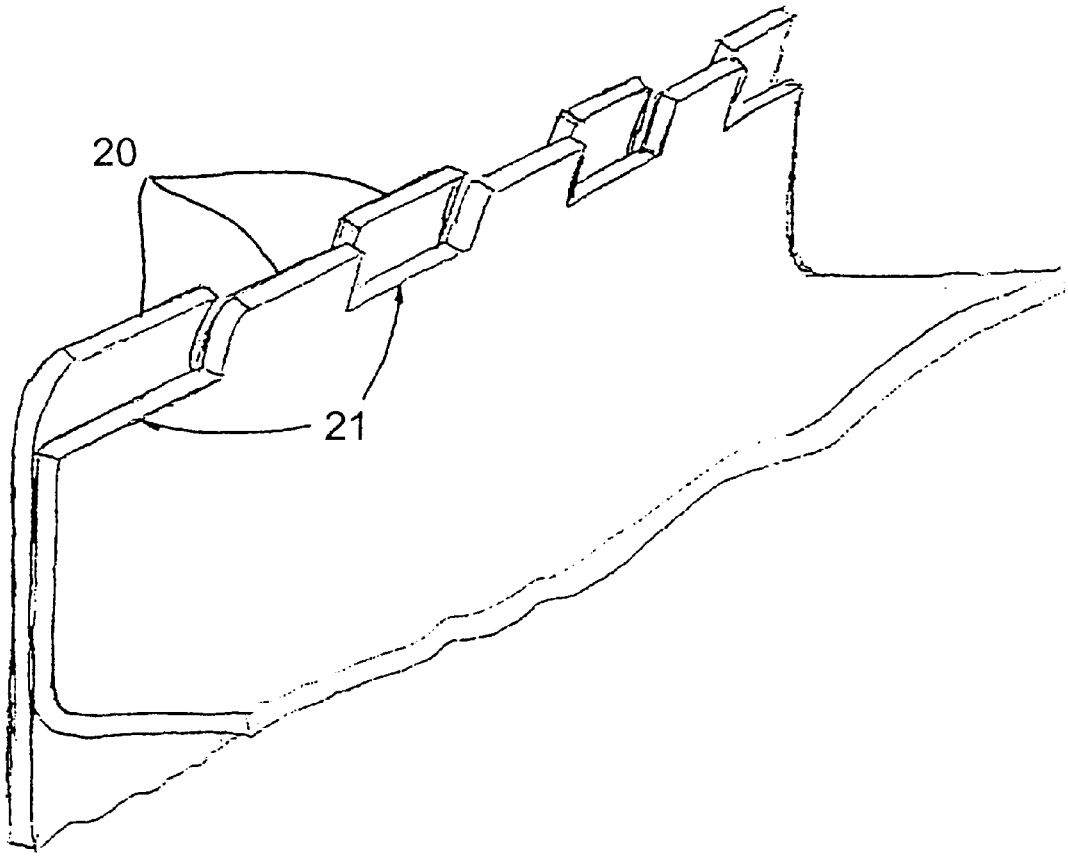
FIGS. 8*a* and 8*b* show the two metal plates just before achieving the hem.
Figure 8B:
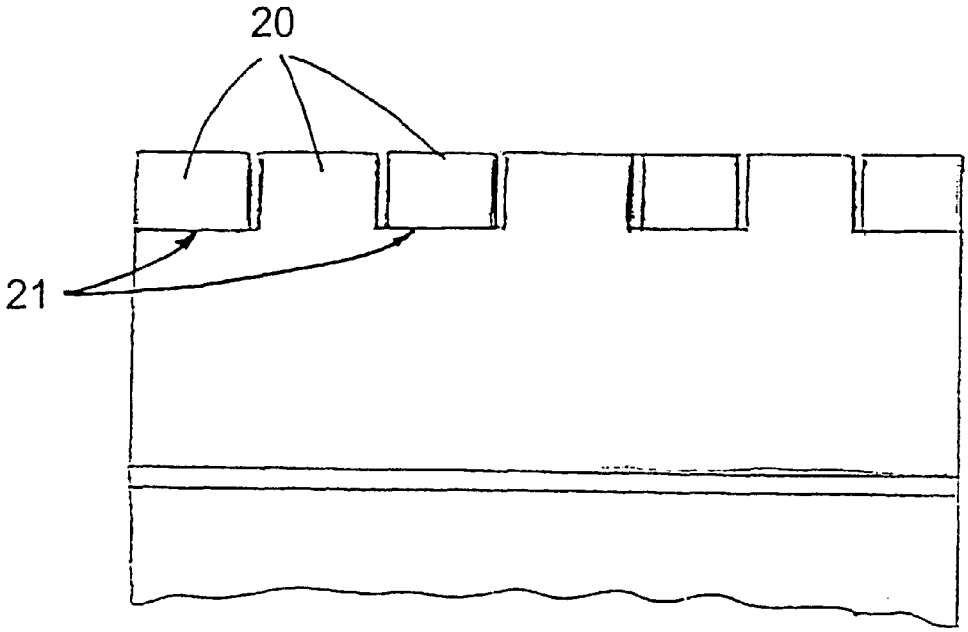

Alternate serrated spaces may also be cut out of the flange and the corresponding web, so as to ensure longitudinal blocking of the parts (FIG. 8). These cut-out spaces are made during the manufacturing steps of these parts by press and their height is inferior to the circumference of the hem, for example one-third of this circumference. The width of the teeth 20 is slightly inferior to that of the gaps 21. During the hem assembling of the two metal sheets, the teeth of the plate closest to the axis of the hem are imbricated in the space between the teeth of the outer metal sheet, thus producing blocking along the axis of the hem.

Figure 5:
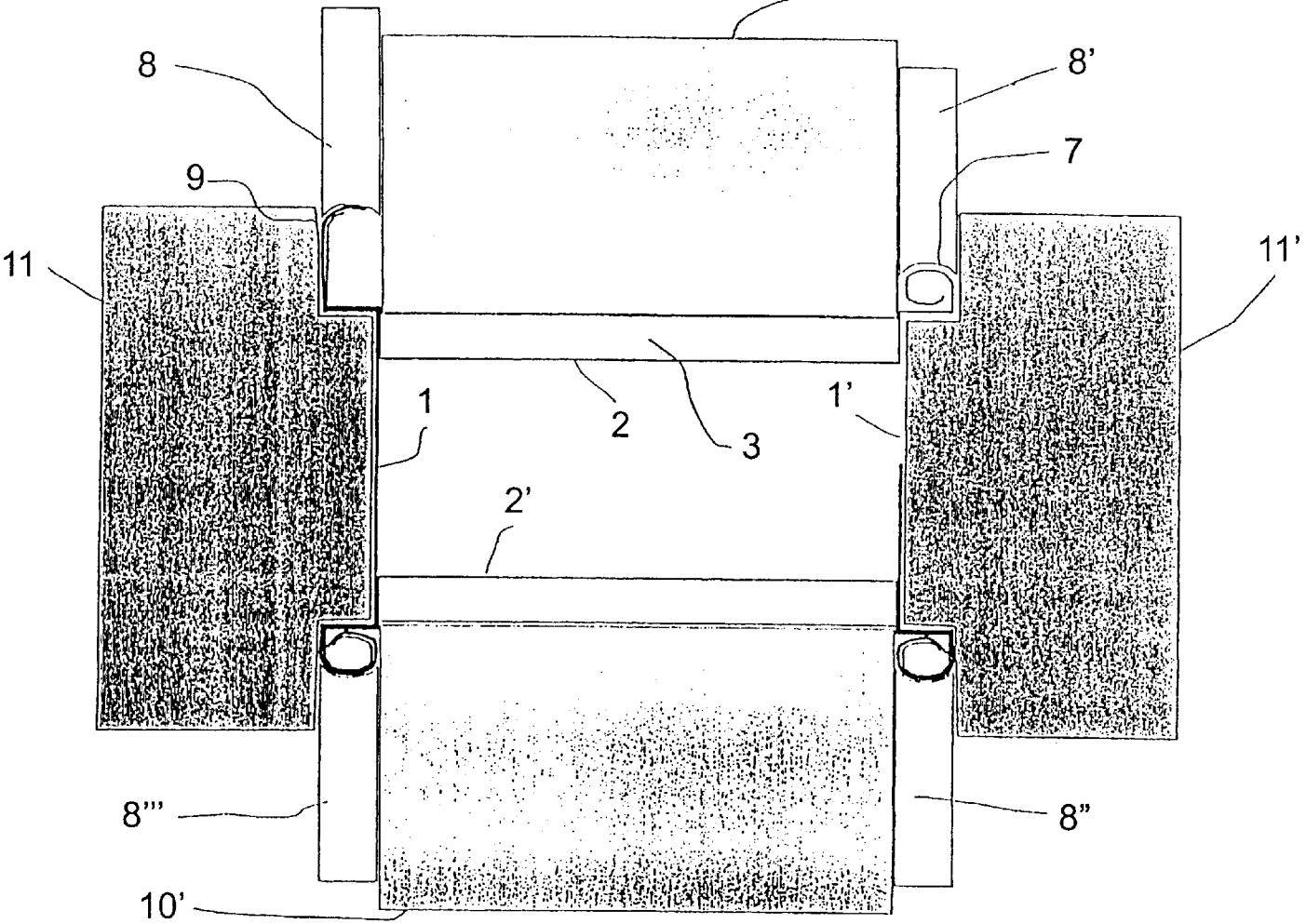
FIG. 5 shows the tools used to produce a hem assembly by press such as shown in FIG. 4.

FIG. 5 shows an example of tools for performing this hem assembly by press. The flanges 1 and the webs 2 are prepared for forming the hem as indicated at 9: they receive a preform that primes the hem. The parts are then placed in the tools composed of moving parts 10; 10' and 11, 11'. These moving parts are thus first separated, horizontally for 11 and 11' and vertically for 10 and 10'. The parts 1 and 1' are respectively placed on 11 and 11' and held by means that are not shown, for example a magnetic system. Similarly, the webs 2 and 2' are placed on the moving parts 10 and 10' which match the form of the corrugation 3. The parts 10 and 10' are then brought into the position indicated in FIG. 5, followed by the parts 11 and 11': the tools 8, 8', 8" and 8'" are then in the situation indicated for the tool 8. The tools 8 are then simultaneously or successively moved to form the hem and to be in the position indicated by 8', 8" and 8'". This type of tools can be mounted on a press, the parts 11 being set in motion by a cam system generating a horizontal motion when the press is closed, the parts 10, 8 and 8' being set in motion by the top slide of the press: 10 is spring-mounted and its path is limited by a stop that is not shown, 8 and 8' are directly fixed to the press slide. The part 10' rests on the press table and is thus fixed, the tools 8" and 8'" being set in motion by means of a bottom slide of the press. This type of assembly method by means of a press tool allows to produce forms with a non-permanent cross section: the distance between the flanges 1 and 1' and between the webs 2 and 2' varies.

Figure 6:
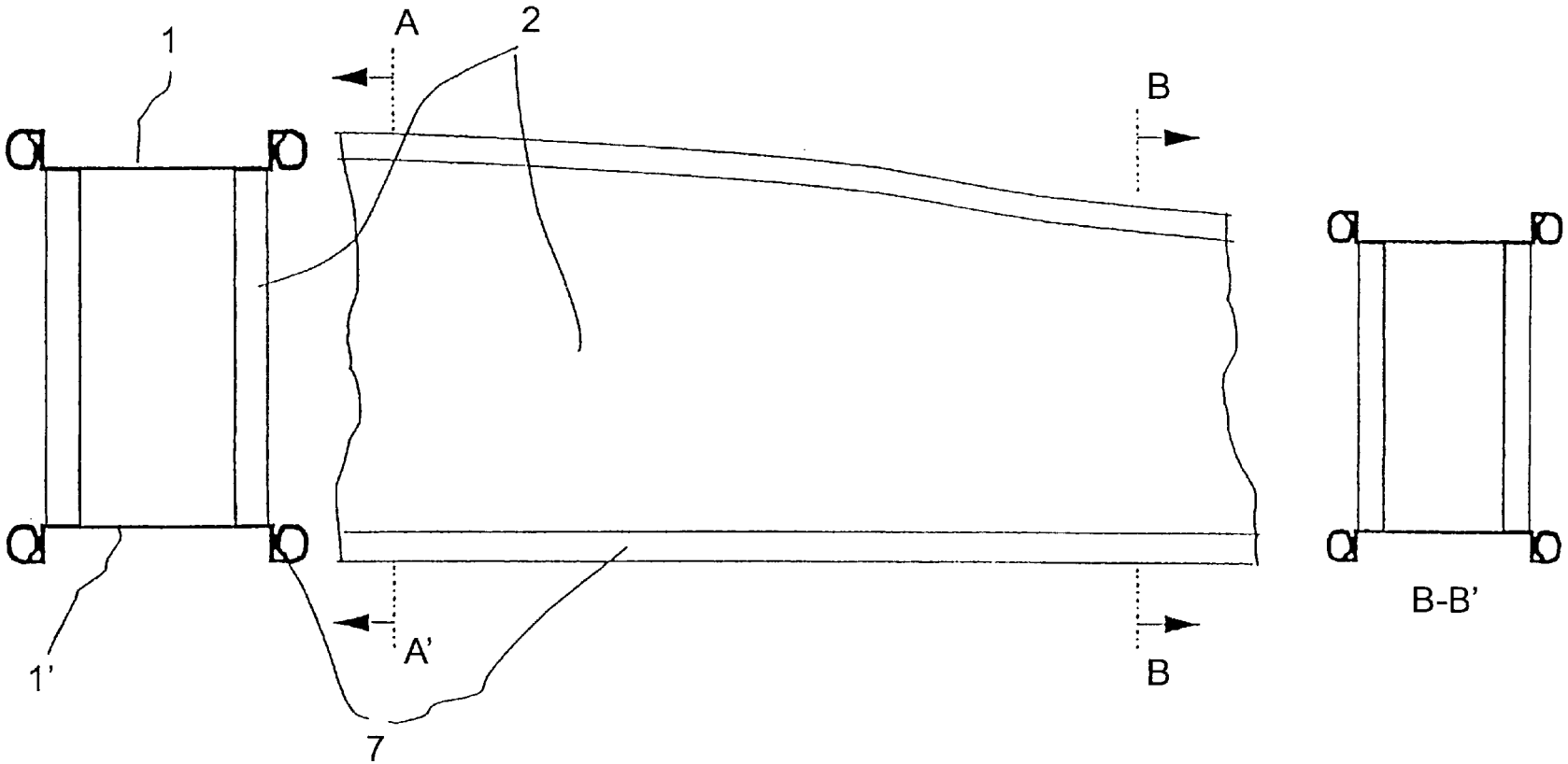
FIG. 6 shows a cross-section view of a girder element with a variable cross section along the line A–A' and along the line B–B'.

FIG. 6 shows a view of a girder part with a variable cross section: the cross section A–A' is wider and higher than the cross section B–B'.

For profiles of permanent cross section, this type of hem assembling can also be performed by means of roll tools according to known methods. The system can then be integrated into a profiling line.

Figure 7:
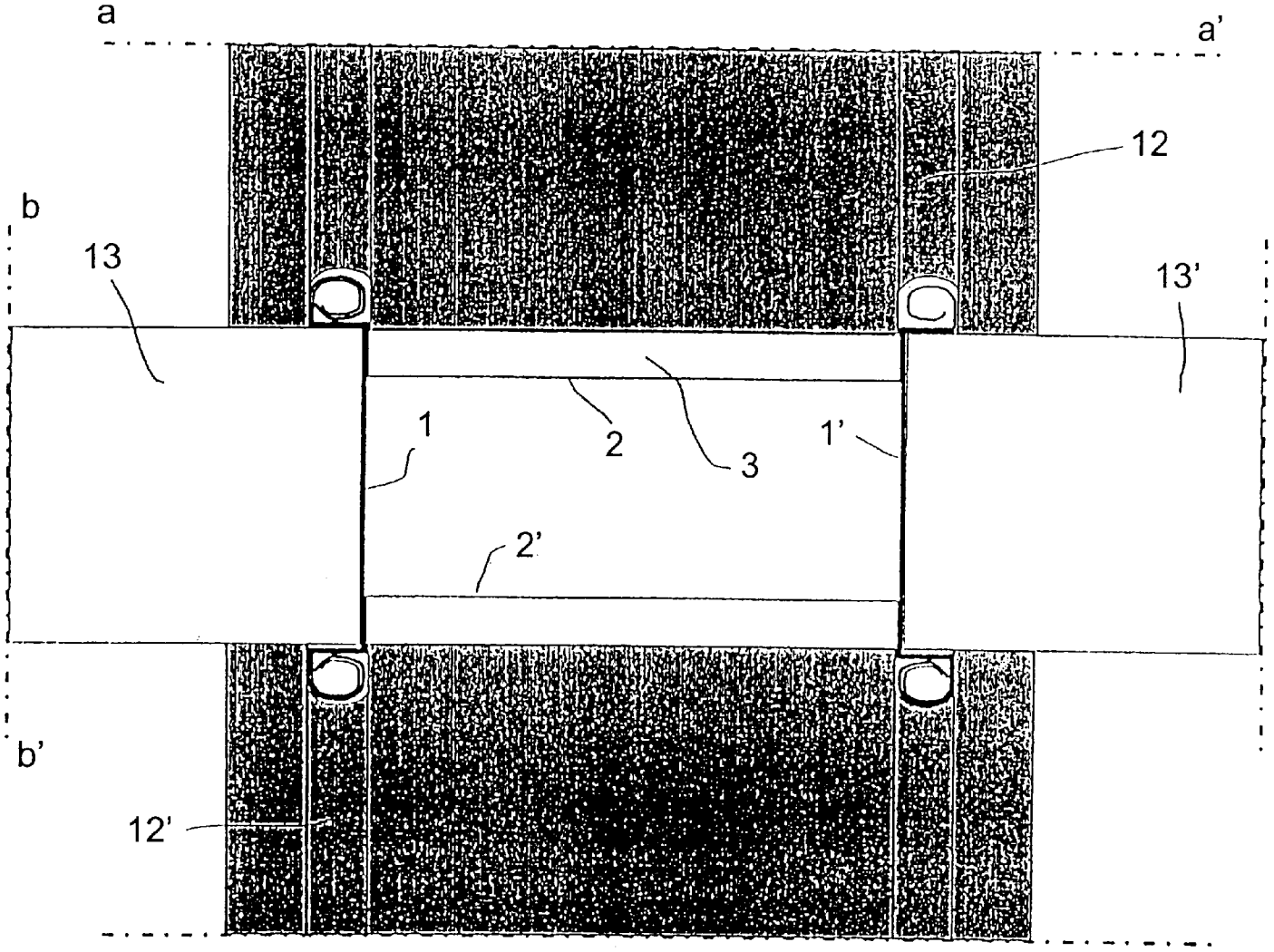
FIG. 7 is a basic diagram of a tool functioning by press in order to allow the production of a girder structure according to the present invention, and in particular as shown in FIG. 1.

FIG. 7 shows the basic diagram of such an assembly by rollers. Two rollers 13 and 13' of vertical axes b–b' laterally hold the flanges, the hem being made by two rollers 12, 12' of horizontal axes a–a' . Depending on the difficulty in producing the hem, several trains of rollers as described in FIG. 7 may be used to gradually produce the hem.

What is claimed is:

1. A girder structure comprising at least one flange made of at least one first metal with high mechanical resistance, having an elastic limit/breaking load ratio close to 1, and at least one web made of at least one second metal having an elastic limit substantially inferior to that of the first metal, said web being essentially assembled perpendicular to said flange, said flange and said web being made of sheet metal or plate metal, the second metal having an elastic limit/breaking load ratio substantially inferior to the value of said ratio of the first metal, and of less than 0.9;

said web having geometrical characteristics that increase its buckling strength in comparison with a flat and full web of the same thickness and the same height, allowing to decrease its thickness and consequently lower the total weight of the structure.

2. The girder structure according to claim 1, wherein the first metal is a steel with an elastic limit higher than 400 MPa or an aluminium alloy with an elastic limit high than 200 Mpa.

3. The girder structure according to claim 1, wherein the web has a corrugation in the longitudinal direction of said structure.

4. The girder structure according to claim 1, wherein the web has a succession of lances or apertures in the longitudinal direction of said structure.

5. The girder structure according to claim 1, and further comprises at least two flanges essentially parallel to each other.

6. The girder structure according to claim 1, and further comprises at least two flanges essentially parallel to each other and at least two webs essentially parallel to each other.

7. The girder structure according to claim 1, wherein the flanges and the webs are made of metallic materials that differ in their nature, their mechanical properties or their thickness.

8. The girder structure according to claim 5, wherein the two flanges are made of the same metal.

9. The girder structure according to claim 5, wherein the two flanges are made of different metals, a first flange being made of a metal with an elastic limit/breaking load ratio different from that of the metal of the other flange.

10. The girder structure according to claim 8, wherein the two flanges have different thickness.

11. The girder structure according to claim 1, and further comprises a non-permanent cross section that varies according to the height and/or width of said structure.

12. A method for assembling a girder structure comprising at least one flange and at least one web, and said at least one flange made of at least one first metal with high mechanical resistance, having an elastic limit/breaking load ratio close to 1, and said at least one web made of at least one second metal having an elastic limit substantially inferior to that of the first metal, said web being essentially assembled perpendicular to said flange, said flange and said web being made of sheet metal or plate metal, the second metal having an elastic limit/breaking load ratio substantially inferior to the value of said ratio of the first metal, and of less than 0.9;

said web having geometrical characteristics that increase its buckling strength in comparison with a flat and full web of the same thickness and the same height, allowing to decrease its thickness and consequently lower the total weight of the structure, said method comprising the step of:

assembling said flange and said web in order to form a junction section by means of a fusion assembly method, consisting of at least one of the following spot welding, laser welding, seam welding, diffusion welding or brazing.

13. A method for assembling a girder structure comprising at least one flange and at least one web, said at least one flange being made of at least one first metal with high mechanical resistance, having an elastic limit/breaking load ratio close to 1, and said at least one web being made of at least one second metal having an elastic limit substantially inferior to that of the first metal, said web being essentially assembled perpendicular to said flange, said flange and said web being made of sheet metal or plate metal, the second metal having an elastic limit/breaking load ratio substantially inferior to the value of said ratio of the first metal, and of less than 0.9;

said web having geometrical characteristics that increase its buckling strength in comparison with a flat and full web of the same thickness and the same height, allowing to decrease its thickness and consequently lower the total weight of the structure, said method comprising the step of:

assembling said flange and said web in order to form a junction section by a mechanical assembly method, including rivetting, simple crimping or clinching.

14. The assembly method according to claim 13, wherein the assembly is performed by means of a press.

15. A method for assembling a girder structure comprising at least one flange and at least one web, said at least one flange being made of at least one first metal with high mechanical resistance, having an elastic limit/breaking load ratio close to 1, and said at least one web being made of at least one second metal having an elastic limit substantially inferior to that of the first metal, said web being essentially assembled perpendicular to said flange, said flange and said web being made of sheet metal or plate metal, the second metal having an elastic limit/breaking load ratio substantially inferior to the value of said ratio of the first metal, and of less than 0.9;

said web having geometrical characteristics that increase its buckling strength in comparison with a flat and full web of the same thickness and the same height, allowing to decrease its thickness and consequently lower the total weight of the structure, said method comprising the step of:

assembling said flange and said web in order to form a junction section by hem crimping.

16. The assembly method according to claim 15, wherein the ratio of the hem radius to the sum of the thicknesses of the various constituent elements along the junction section is between 2 and 10.

17. The assembly method according to claim 15, wherein the ratio of the difference between the radius of the hem and the thickness of the outermost constituent element to the thickness of the innermost constituent element is higher than 2, and in that the thickness ratio of the two elements is lower than 4.

18. The method for assembling a girder structure according to claim 15, wherein the hem assembly is performed in the same press cycle.

19. The method for assembling a girder structure according to claim 15, wherein after said hem crimping, a blocking of said hem with respect to the relative sliding of a web relative to a flange along the junction section, is achieved by bonding, indentation or imbrication.

20. The assembly method according to claim 15, wherein an adhesive is placed between two sheets of metal at the hem junction section.

21. The assembly method according to claim 15, wherein welds are produced by local fusion at the hem junction section.

22. The assembly method according to claim 15, wherein the hem is locally crushed with a press tool comprising a V-shaped indenting punch with a rounded end and a flat anvil.

23. The assembly method according to claim 22, wherein the indentation pitch is comprised between 5 and 10 times the outside diameter of the hem.

24. The assembly method according to claim 18, wherein serrated spaces are cut out of the flange and corresponding web during manufacturing steps of these parts by press, so as to ensure longitudinal blocking of said parts.

25. The assembly method according to claim 24, wherein the height of the cut-out spaces is inferior to the circumference of the hem, teeth having a width slightly inferior to that of gaps.

* * * * *